US005181329A

United States Patent [19]

Devaney, Jr. et al.

[11] Patent Number: 5,181,329

[45] Date of Patent: Jan. 26, 1993

[54] DRYING APPARATUS

[75] Inventors: Mark J. Devaney, Jr., Rochester; Lee F. Frank; Jeffrey L. Helfer, both of Webster; Haribhajan S. Kocher, Penfield; Paul M. Wagner, Holley, all of N.Y.

[73] Assignee: Eastman Kodak Company, Rochester, N.Y.

[21] Appl. No.: 633,507

[22] Filed: Dec. 28, 1990

[51] Int. Cl.[5] ..... F26B 13/00

[52] U.S. Cl. ..... 34/156; 34/160

[58] Field of Search ..... 34/154, 155, 156, 160, 34/162, 151, 23; 226/97

[56] References Cited

U.S. PATENT DOCUMENTS

| | | | |
|---|---|---|---|
| 2,492,974 | 1/1950 | Dungler | 34/160 |
| 3,041,739 | 7/1962 | Meier-Windhorst | 34/160 |
| 3,324,570 | 6/1967 | Flaith et al. | 34/156 |
| 3,662,476 | 5/1972 | Capizzi | 34/160 |
| 3,672,066 | 6/1972 | Stephansen | 34/160 |
| 3,805,409 | 4/1974 | Sato et al. | 34/160 |
| 4,467,537 | 8/1984 | Trötscher | 34/160 |
| 4,472,888 | 9/1984 | Spiller | 34/160 |
| 4,594,795 | 6/1986 | Stephansen | 34/156 |
| 4,901,449 | 2/1990 | Wimberger | 34/156 |

*Primary Examiner*—Henry A. Bennet
*Assistant Examiner*—Denise L. F. Gromada
*Attorney, Agent, or Firm*—Frank Pincelli

[57] ABSTRACT

Apparatus for drying a web comprises a pair of spaced parallel plates defining a channel there between of predetermined thickness and length for receiving the web. The plates are provided with juxtaposed elongated openings respectively for injecting drying air into the channel on opposite sides of the web. Air under pressure is supplied to the openings to establish a high velocity laminar flow of air from the openings in opposite directions along the surface of the web. Air is evacuated from the channel on opposite sides of the web at a predetermined distance from said openings to maintain the heat transfer rate in the air higher than the heat transfer rate in the web.

7 Claims, 3 Drawing Sheets

DRYING APPARATUS

CROSS REFERENCE TO RELATED APPLICATIONS

Reference is made to the following commonly assigned copending application filed concurrently herewith:

1. U.S. application Ser. No. 07/633,505 entitled "Apparatus for Enhancing Heat and Mass Transfer in a Fluid Medium." and filed by Lee F. Frank, Jeffrey L. Helfer, Haribhajan S. Kocher and Paul W. Wagner. The disclosure of this application is incorporated herein by reference.

2. U.S. application Ser. No. 07/633,495 entitled "Drying Apparatus" and filed by, Mark Devaney, Jr., Lee F. Frank, Jeffry L. Helfer, Haribhajan S. Kocher and Paul W. Wagner.

TECHNICAL FIELD

This invention relates to apparatus for subjecting web material to treatment with fluids and, more particularly to apparatus for drying light sensitive material such as photographic film or paper during processing.

BACKGROUND ART

Conventional Film and paper Drying in the photo processing trade is typically done by moving the web on a series of rollers through a heated chamber. A fan or blower is used to move air over a resistance heater, around the film and out of the processor into the surrounding work area. Higher volume units use an impingement jet dryer in which a blower pressurizes a plenum with heated air. Slots cut into the plenum allow streams of air to blow against the surface of the film. These slots are typically an inch or so from the film to allow the stream to spread over the surface of the film. In both cases large amounts of costly heated air must be vented to the environment, heating the surrounding room. In addition, heated air escapes within the processor, heating the processor solutions.

The above inefficiencies are the result of conventional film (or paper) processing devices not providing a sufficient level of agitation at the film-air interface. As a result, a region of reduced temperature, is created in the layer of air which exists at the film surface during the drying process of the processor. This layer is the thermal boundary layer.

Analysis and experimental measurements of conventional dryers indicate that boundary layers exist which are thick enough so as to become the drying rate limiting parameter. More specifically, the transfer of chemical mass and heat energy through the thermal boundary layer occurs more slowly than transfer through the film itself. This condition results in low drying speeds, excessively long film paths and increased size of the dryer. Drying temperatures need to be excessively high to maintain reasonable film drying rates resulting in inefficient utilization of thermal energy.

DISCLOSURE OF THE INVENTION

In commonly assigned application Ser. No. 07/633,505 cross referenced above and incorporated herein by reference, there is disclosed apparatus for minimizing the boundary layer between light sensitive material and a treating fluid. It is an object of the present invention to incorporate the concepts disclosed in that application into apparatus having particular utility in the drying of web material.

In accordance with the invention, the speed of a jet of heated air is raised to force the jet to travel along the surface of the film to reduce the thickness of both the thermal and vapor boundary layers that form at the film/air interface. This reduction in boundary layer thickness reduces resistance to the flow of heat into the film (required to vaporize moisture) as well as the flow of moisture out of the film and into the air to such a degree that moisture can be removed from the film/paper at a very rapid rate with greatly reduced air volumes and heat/energy loads. (A reduced boundary layer thickness translates into a higher heat or vapor transport coefficient) Confining the air flow to a narrow gap in the plane of the film extends the boundary layer reduction effect for a considerable distance beyond where the jet of air actually hits the film/paper.

The embodiment disclosed is designed to provide these reductions in boundary layers and extended flow along the film/paper surface. In addition, the embodiment provides an air bearing to float the film or paper between the operating surfaces eliminating mechanical defects in the dried surface due to the effects of rollers etc.

BRIEF DESCRIPTION OF THE DRAWINGS

Other objects and advantages will become apparent form the following description taken in connection with the accompanying drawings wherein.

MODE OF CARRYING OUT THE INVENTION

Figure 1:
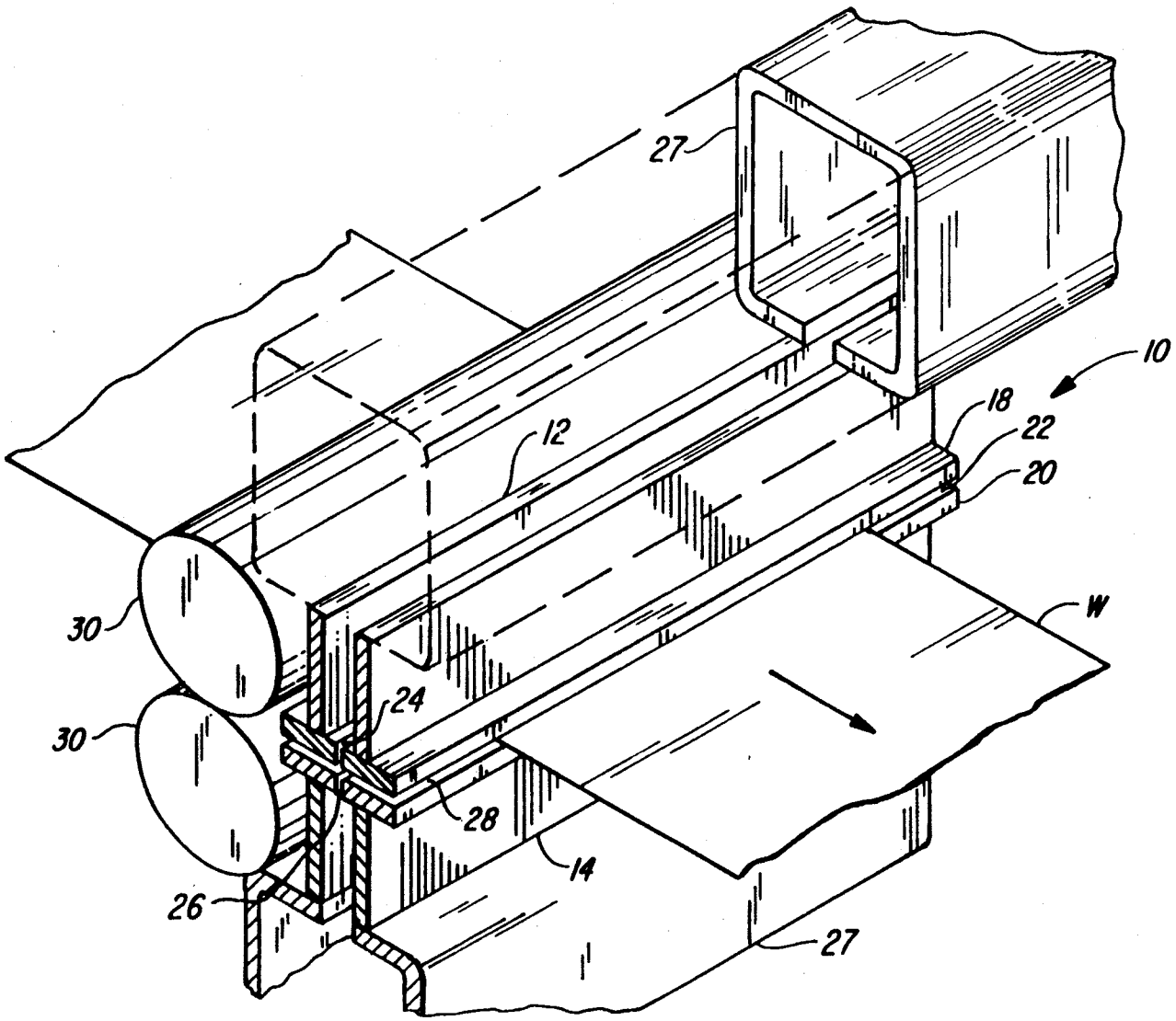
FIG. 1 is a perspective view of a dryer in accordance with the present invention.
Figure 2:
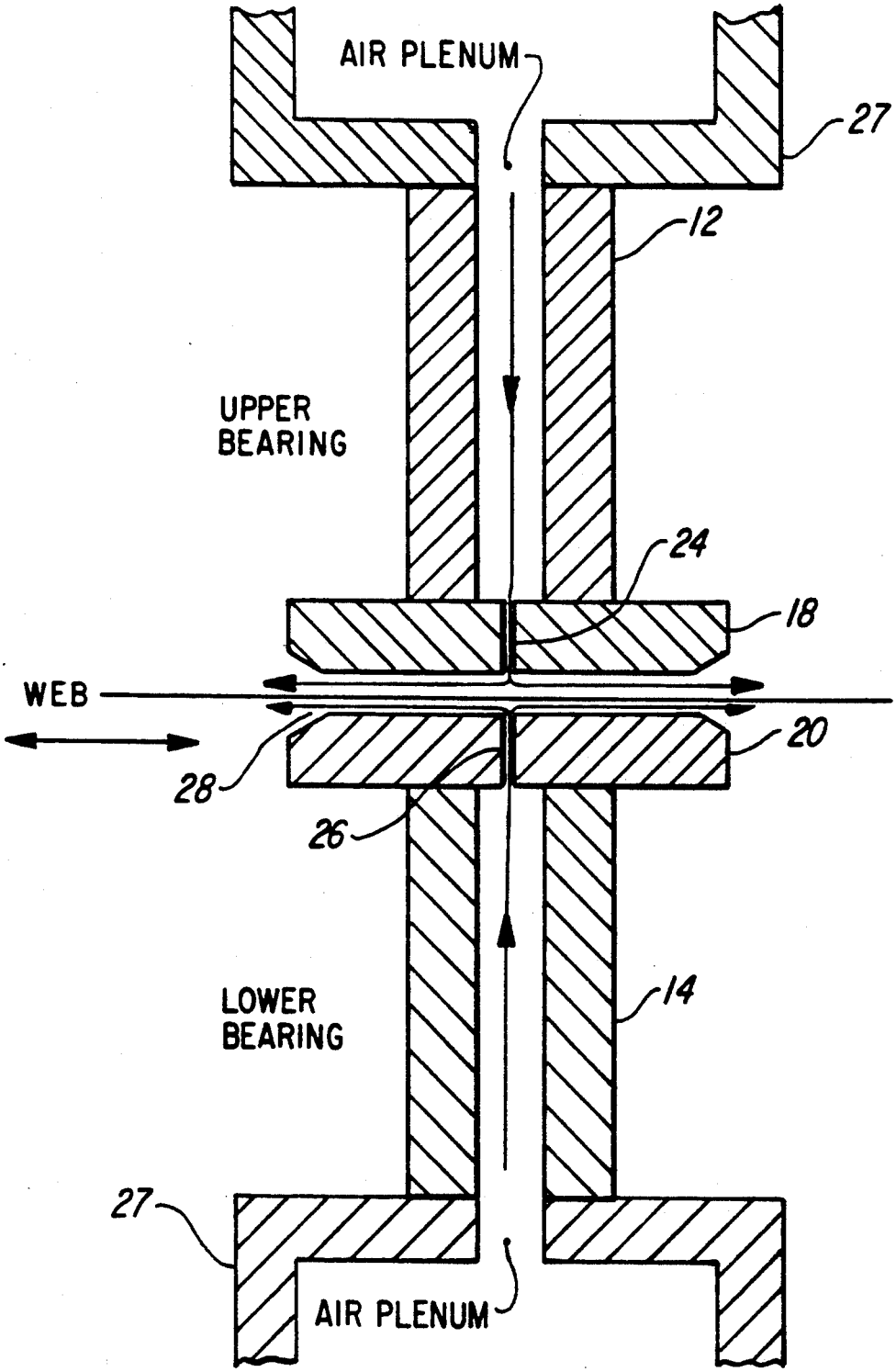
FIG. 2 is a cross section of the air bearings shown in FIG. 1.

Referring to FIGS. 1 and 2 of the drawings there is shown a film or paper dryer 10 comprising a pair of juxtaposed air bearings 12, 14. The bearings 12, 14 comprises rectangular housings having sidewalls, end walls and cover plates (not shown) attached to spaced parallel plates 18, 20 respectively. The plates are fixed together in spaced relationship with spacers 22 interposed to provide the desired spacing described below. The plates 18, 20 are provided with central elongated openings or slits 24, 26, for injecting air under pressure into the space between the plates from the interior of the bearing housings, respectively. A plenum 27 (one is shown in FIG. 1) connected to a source of air under pressure is attached to each housing.

As shown in FIG. 1 the bearings 12, 14 are spaced to define a channel 28 there between for a web W which may comprise light sensitive material. The web W may be transported to the channel 28 by a pair of nip rollers 30 which may comprise the exit squeegee rollers of a wash section of a film processor. Preferably, the air bearings are skewed 10 to 15 degrees from the longitudal axis of the rollers to reduce aeroelastic flutter in the leading and trailing portions of the web.

In operation of the dryer air under pressure will be injected from the plenums 27 into the bearings 12, 14 and through the slits 24, 26 into the channel 28 to establish regions of air under pressure on opposite sides of the film. As a result a laminar flow of air will occur in opposite directions from each slit relative to the film path. The air streams will exit the channel 28 at the opposite sides of the plates 18, 20.

The thickness and length of channel 28, width of slits 24, 26, air pressure with the bearings 12, 14 are parameters which are preferably selected to control the boundary layer thickness and to minimize the distance over which the boundary is permitted to develop. Also the system parameters are selected to establish reasonably high fluid velocities in the laminar flow region to minimize the rate at which the boundary layer is allowed to grow. The result is to establish a heat transfer rate in the fluid that exceeds the heat transfer rate within the film or paper. A small plate separation contributes to the achievement of high fluid velocities with laminar flow. These concepts are more fully disclosed in copending application Serial No. 07/633,505 cross referenced above and incorporated herein by reference.

In accordance with the teachings of application Ser. No. 07/633,505 the thickness of channel 28 is preferably 0.06–0.09 inches. The length of the fluid path along the film direction is in the range of 0.3 to 0.8 inches depending on the total amount and transfer rate of heat needed. The slots 24, 26 in the plates 18, 20 are preferably 0.015 inches wide. Air with the bearing is typically at 3.4 inches of water pressure and a temperature of 90 to 130 degrees Fahrenheit depending on the drying speed needed and particular film characteristics such as amount of gel, etc.

The pressure drop in the slots 24, 26 is approximately 50 percent of the available pressure. Pressure at the film plane is dependant on the flow rate of air through the slot, the higher the flow rate the greater the pressure drop. As discussed in copending application Ser. No. 07,633,505 incorporated herein by reference if the film moves from a center position towards either plate a pressure differential is established above and below the film which restores it to a center position. With the film thus centered in the channel 28 the boundary layer thickness reduction discussed above, and thereby improved heat and water vapor flow, is provided by the high speed flow of air from the slits over the film and out the sides of the bearings. Control of boundary layer thickness is a function of the channel size, length of the channel and the pressure of the air injected through the slits. Heat flow to the film is a function of air temperature and also boundary layer thickness. Water vapor removal is primarily a function of boundary layer thickness and the rate heat can be supplied to vaporize water in the gel coat of the film or paper.

Figure 3:
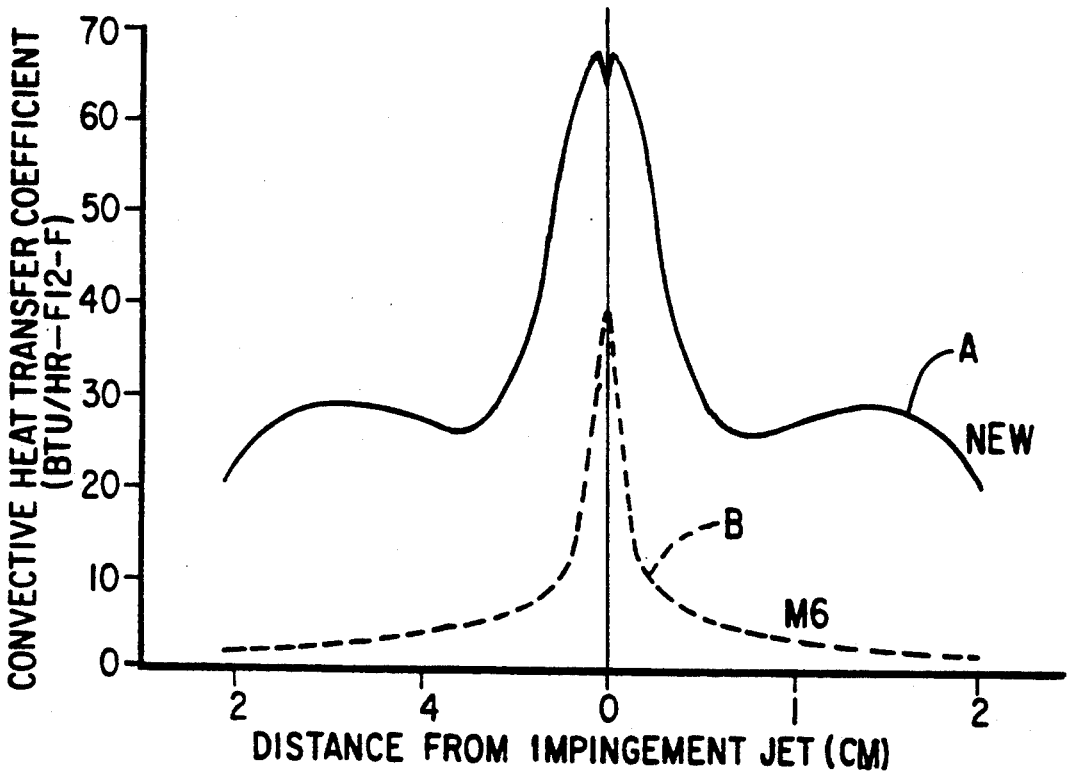
FIG. 3 shows actual measured heat transfer coefficient values for a 4 cm wide bearing versus the impingement jet system of a commercially available dryer.

FIG. 3 depicts curves plotted from actual measured heat transfer coefficient values for a dryer in accordance with the invention (curve A) having 4 cm wide bearing plates 18, 20 and a commercially available M6B XOMAT dryer (curve B) manufactured by Eastman Kodak Company. As can be seen from FIG. 3 the average value of the M6B dryer is approximately 7 BTU per hour per square foot per degree Fahrenheit whereas the dryer in accordance with the invention has an average value of approximately 38 BTU per hour per square foot per degree Fahrenheit. This dramatic increase in efficiency indicates the superior performance of apparatus in accordance with the invention. Most significant is the fact that this improvement in drying efficiency was achieved with a much smaller and lower cost dryer.

It will be apparent that different web materials may require longer or smaller bearing widths (flow path lengths) or even multiple bearings.

It will now be apparent that the invention achieves higher heat transfer coefficiates which means faster drying, smaller simpler dryers, lower drying temperatures and less energy consumption. The air suspension of the film or paper in the dryer reduces the chance of film scratches/artifacts in the dryer. Less drying energy means less heat lost to the environment, less need to cool the processing chemicals and no need for special power connections to the processor.

The simplicity and small size of the dryer requires fewer parts and greatly reduces the cost of the dryer.

Those skilled in the art to which the invention relates will appreciate that various substitutions and modifications can be made to the described embodiment without departing from the spirit and scope of the invention as described by the claims below.

We claim:

1. Apparatus for drying a web comprising:

a pair of spaced parallel members having flat surfaces defining a channel there between of predetermined length and thickness for transport of the web there between;

juxtaposed elongated openings in said surfaces respectively;

means for supplying air under pressure to said openings to establish cushions of air on opposite sides of the web and a high velocity laminar flow of air in opposite directions from said openings over the surface of the web, the web being supported in said channel by said cushions of air and said laminar flow of air;

and means for evacuating air from said channel on opposite sides of the web at a predetermined distance from said openings to maintain the heat transfer rate in the air in said channel higher than the heat transfer rate in the web.

2. Apparatus as claimed in claim 1 wherein said members comprise flat plates and said openings comprise elongated slits in said plate respectively.

3. Apparatus as claimed in claim 2 wherein said means for supplying air to said slits comprises elongated housings attached to said plates respectively, each of said housings defining a chamber for air under pressure.

4. Apparatus as claimed in claim 3 further including a plenum attached to each of said housings.

5. Apparatus for drying a web of light sensitive material comprising:

a pair of spaced parallel members having surfaces defining a channel there between of predetermined length and thickness for transport of the web there between;

juxtaposed elongated slits in said surfaces respectively;

means for supplying air under pressure to said slits to establish cushions of air on opposite sides of the web and a high velocity laminar flow of air in opposite directions from said openings over the surface of the web, the web being supported in said channel by said cushions of air and said laminar flow of air; and means for evacuating air from said channel on opposite sides of the web at a predetermined distance from said openings to maintain the heat transfer rate in the air in said channel higher than the heat transfer rate in the web.

6. Apparatus as claimed in claim 5 wherein said means for supplying air to said slits comprise elongated housings attached to said members respectively, each of said housings defining a chamber for air under pressure.

7. Apparatus as claimed in claim 6 further including a plenum attached to each of said housings.

* * * * *